US011793303B1

(12) United States Patent
Chen

(10) Patent No.: US 11,793,303 B1
(45) Date of Patent: Oct. 24, 2023

(54) TELESCOPIC PANEL COMPONENT AND TABLE

(71) Applicant: Sophia & William Brands Co. LTD, Nanjing (CN)

(72) Inventor: Meidi Chen, Nanjing (CN)

(73) Assignee: SOPHIA & WILLIAM BRANDS CO. LTD, Nanjing (CN)

( * ) Notice: Subject to any disclaimer, the term of this patent is extended or adjusted under 35 U.S.C. 154(b) by 0 days.

(21) Appl. No.: 17/897,654

(22) Filed: Aug. 29, 2022

(30) Foreign Application Priority Data

Jun. 17, 2022 (CN) ..... 202210692851.1

(51) Int. Cl.
*A47B 1/05* (2006.01)
*A47B 1/10* (2006.01)

(52) U.S. Cl.
CPC ..... *A47B 1/05* (2013.01); *A47B 1/10* (2013.01); *A47B 2001/053* (2013.01)

(58) Field of Classification Search
CPC .... A47B 1/10; A47B 1/03; A47B 1/05; A47B 2001/005; A47B 2001/053
See application file for complete search history.

(56) References Cited

U.S. PATENT DOCUMENTS 2,699,975 A * 1/1955 Ranney ..... A47B 1/03 108/67
5,806,437 A * 9/1998 Huang ..... A47B 1/02 108/86
9,622,568 B1 * 4/2017 Lin ..... A47B 13/081
2007/0012226 A1 * 1/2007 Chen ..... A47B 1/03 108/86
2017/0156489 A1 * 6/2017 Tippmann ..... A47B 1/10
2022/0338615 A1 * 10/2022 Andersson ..... A47B 1/02
2022/0400845 A1 * 12/2022 Choi ..... A47B 1/08
2023/0147736 A1 * 5/2023 Jiang ..... A47B 1/04 108/86

* cited by examiner

*Primary Examiner* — Daniel J Rohrhoff
(74) *Attorney, Agent, or Firm* — Chun-Ming Shih; LANWAY IPR SERVICES

(57) ABSTRACT

The present disclosure provides a telescopic panel component and a table, relates to the technical field of furniture, and solves the technical problem that the size of a panel component of a table is fixed and cannot be adjusted. The telescopic panel component comprises a frame, a first panel and a second panel, wherein a slideway is provided on the frame, and the second panel is slidably connected with the slideway; the panel component has a retracted state and an unfolded state, and when the second panel slides along the slideway to the side of the first panel under the action of an external force, the first panel is rotatable on the frame; the first panel turns over forward, and the first panel is rotatable below the second panel, so that the panel component is in the retracted state; the first panel turns over reversely, and the first panel is rotatable to the position where the first panel is spliced with the second panel, so that the panel component is in the unfolded state. The supporting area of the panel component surface can be adjusted telescopically, which can be applied to holes in a smaller space and a larger space, thus improving the universality of the table and making it more convenient to use.

7 Claims, 5 Drawing Sheets

TELESCOPIC PANEL COMPONENT AND TABLE

TECHNICAL FIELD

The present disclosure relates to the technical field of furniture, in particular to a telescopic panel component and a table.

BACKGROUND

A table in the prior art comprises a leg and a panel component, wherein the leg is fixedly connected with the panel component and is used to support the panel component.

The applicant has found that there are at least the following technical problems in the prior art. The size of a panel component of a table determines the usable area of the table. In the prior art, the size of the panel component is fixed and cannot be adjusted. A table with a larger panel component is suitable for a larger space, and a table with a smaller panel component is suitable for a smaller space. Therefore, the table in the prior art has a narrow application range and is inconvenient to use.

SUMMARY

The purpose of the present disclosure is to provide a telescopic panel component and a table to solve the technical problem in the prior art that the size of a panel component of a table is fixed and cannot be adjusted. Many technical effects that can be produced by the preferred technical scheme among the technical schemes provided by the present disclosure are detailed in the following description.

In order to achieve the above purpose, the present disclosure provides the following technical solutions.

The present disclosure provides a telescopic panel component, comprising a frame, a first panel and a second panel, wherein:

a slideway is provided on the frame, and the second panel is slidably connected with the slideway; the panel component has a retracted state and an unfolded state, and when the second panel slides along the slideway to the side of the first panel under the action of an external force, the first panel is rotatable on the frame;

the first panel turns over forward, and the first panel is rotatable below the second panel, so that the panel component is in the retracted state; the first panel turns over reversely, and the first panel is rotatable to the position where the first panel is spliced with the second panel, so that the panel component is in the unfolded state.

Preferably, the panel component further comprises a third panel, and the third panel is slidably connected with the slideway;

when the second panel and the third panel slide along the slideway to the side of the first panel under the action of an external force, the first panel is rotatable on the frame;

when in the retracted state, the second panel and the third panel are spliced, and the first panel component is located below the second panel and the third panel;

the first panel turns over reversely, the first panel is rotatable to the position where the opposite sides are spliced with the second panel and the third panel, respectively, and the sides of the second panel and the third panel extend out of the frame, so that the panel component is in the unfolded state.

Preferably, the panel component further comprises rotating shaft parts, wherein the rotating shaft parts are located at opposite sides of the first panel and rotatably connect the first panel with the frame;

when in the retracted state, the rotating shaft part is located at the upper part of the first panel, and when in the unfolded state, the rotating shaft part is located at the lower part of the first panel.

Preferably, the panel component further comprises at least two locking mechanisms, and the locking mechanisms enable the second panel and the frame to be in the locking state and the third panel and the frame to be in the locking state, and enable the second panel to be unlocked from the frame and the third panel to be unlocked from the frame.

Preferably, the locking mechanism comprises a tongue and a lock cover, wherein:

the lock cover is rotatably connected to the side of the frame, and is fixed to one side of the second panel or the third panel corresponding to the tongue; a limiting plate is provided on the lock cover, and when the lock cover rotates to the position where the tongue abuts against the limiting plate, the lock cover is capable of limiting the sliding of the second panel and the third panel;

when the lock cover rotates until the limiting plate is separated from the corresponding tongue, the lock cover enables the second panel to be unlocked from the frame or the third panel to be unlocked from the frame.

Preferably, the panel component further comprises a limiting component, the limiting component is connected to the inner side of the frame; when in the retracted state, the upper edge of the first panel abuts against the lower part of the limiting component, and when in the unfolded state, the lower edge of the first panel abuts against the upper part of the limiting component.

Preferably, the limiting component comprises a first roller, the first roller is rotatably connected to the inner side of the frame, and when the second panel and the third panel are pushed or pulled, the second panel and the third panel are capable of being in contact with the upper surface of the first roller and pushing the first roller to rotate around its own axis.

Preferably, the first panel is provided with a second roller, the second roller is located at the upper part of the first panel when in the retracted state, and when the second panel and the third panel are pushed or pulled, the second panel and the third panel are capable of being in contact with the upper surface of the second roller and pushing the second roller to rotate around its own axis.

Preferably, both sides of the first panel are provided with supporting plates for supporting the second panel and the third panel.

The present disclosure further provides a table, comprising legs and the panel component, wherein all the legs are fixedly connected to the lower part of the panel component and support the panel component.

Compared with the prior art, the telescopic panel component and the table provided by the present disclosure have the following beneficial effects. For the telescopic panel component, when the second panel slides to the side of the first panel along the slideway on the frame under the action of an external force, the first panel is rotatable on the frame. When the first panel turns over forward, the first panel is rotatable below the second panel, and the first panel and the second panel form a structure with an upper layer and a lower layer. The panel component is in the retracted state. The panel component only places objects through the second panel, which is suitable for use in a small space. When the first panel turns over reversely, the first panel is rotatable to the position where the first panel is spliced with the second panel, and the two panels are in the same plane, so that the panel component is in the unfolded state. At this time, the panel component can place objects through the first panel and the second panel, and the surface supporting area of the panel component is large, which is suitable for use in a larger space.

Since the table has the telescopic panel component, the supporting area of the surface of the table can be adjusted telescopically, which can be applied to holes in a smaller space and a larger space, thus improving the universality of the table and making it more convenient to use.

BRIEF DESCRIPTION OF THE DRAWINGS

In order to more clearly explain the embodiments of the present disclosure or the technical solutions in the prior art, the drawings that need to be used in the description of the embodiments or the prior art will be briefly introduced. Obviously, the drawings in the following description are only some embodiments of the present disclosure. For those skilled in the art, other drawings can be obtained according to these drawings without creative labor.

In the figures: 1. First panel; 2. Second panel; 3. Third panel; 4. Frame, 5. Legs; 6. Rotating shaft; 7. First roller; 8. Second roller; 9. Locking mechanism; 91. Lock cover; 911. Limiting plate; 92. Tongue; 11. Supporting plate; 12. Slideway.

DETAILED DESCRIPTION OF THE EMBODIMENTS

In order to make the object, technical scheme and advantages of the present disclosure clearer, the technical scheme of the present disclosure will be described in detail below. Obviously, the described embodiments are merely a part of the embodiments of the present disclosure, rather than all of the embodiments. Based on the embodiment of the present disclosure, all other embodiments obtained by those skilled in the art without creative labor belong to the scope of protection of the present disclosure.

In the description of the present disclosure, it should be understood that the orientation or position relationship indicated by the terms "center", "length", "width", "height", "upper", "lower", "front", "rear", "left", "right", "vertical", "horizontal", "top", "bottom", "inner", "outer", "side" and the like is based on the orientation or position relationship shown in the attached drawings, which is only for the convenience of describing the present disclosure and simplifying the description, rather than indicate or imply that the referred devices or elements must have a specific orientation, be constructed and operated in a specific orientation. Therefore, it should not be understood as a limitation of the present disclosure. In the description of the present disclosure, unless otherwise stated, "a plurality of" means two or more.

The embodiment of the present disclosure provides a telescopic panel component and a table. The support area of the surface can be adjusted telescopically, which can be applied to holes in a smaller space and a larger space, thus improving the universality of the table and making it more convenient to use.

The technical scheme provided by the present disclosure will be described in more detail with reference to FIGS. 1-10.

Embodiment 1

As shown in FIGS. 1-10, this embodiment provides a telescopic panel component, comprising a frame 4, a first panel 1 and a second panel 2, wherein: a slideway 12 is provided on the frame 4, and the second panel 2 is slidably connected with the slideway 12; the panel component has a retracted state and an unfolded state, and when the second panel 2 slides along the slideway 12 to the side of the first panel 1 under the action of an external force, the first panel 1 is rotatable on the frame 4; the first panel 1 turns over forward, and the first panel 1 is rotatable below the second panel 2, so that the panel component is in the retracted state; the first panel 1 turns over reversely, and the first panel 1 is rotatable to the position where the first panel is spliced with the second panel 2, so that the panel component is in the unfolded state.

Figure 1:
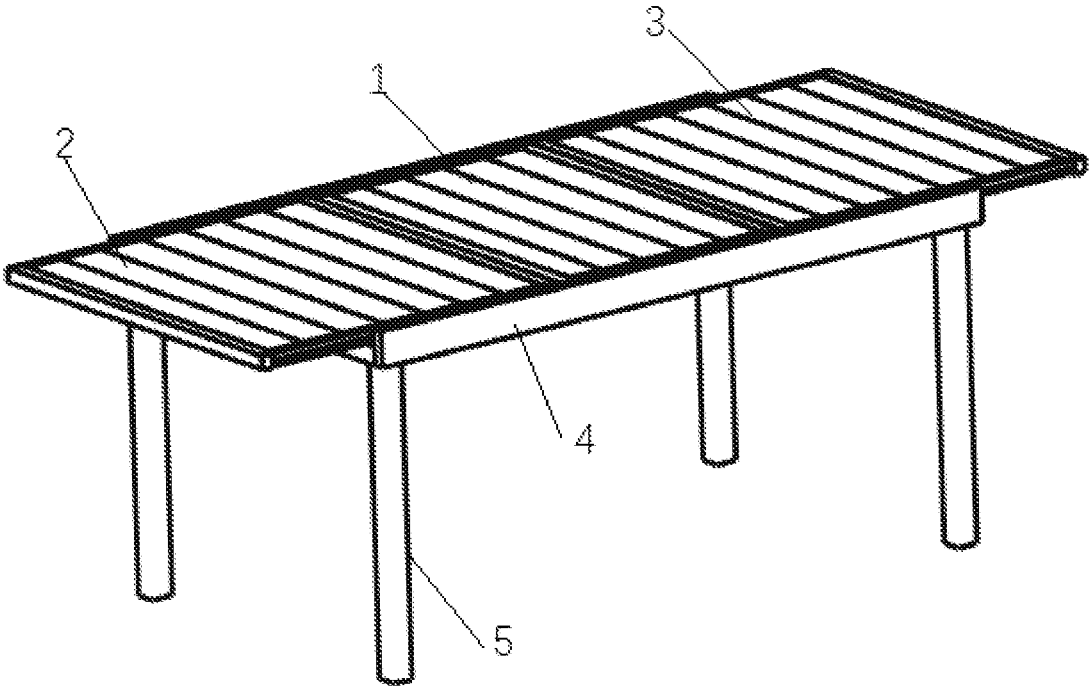
FIG. 1 is a schematic structural diagram of a panel component of a table in the unfolded state.
Figure 2:
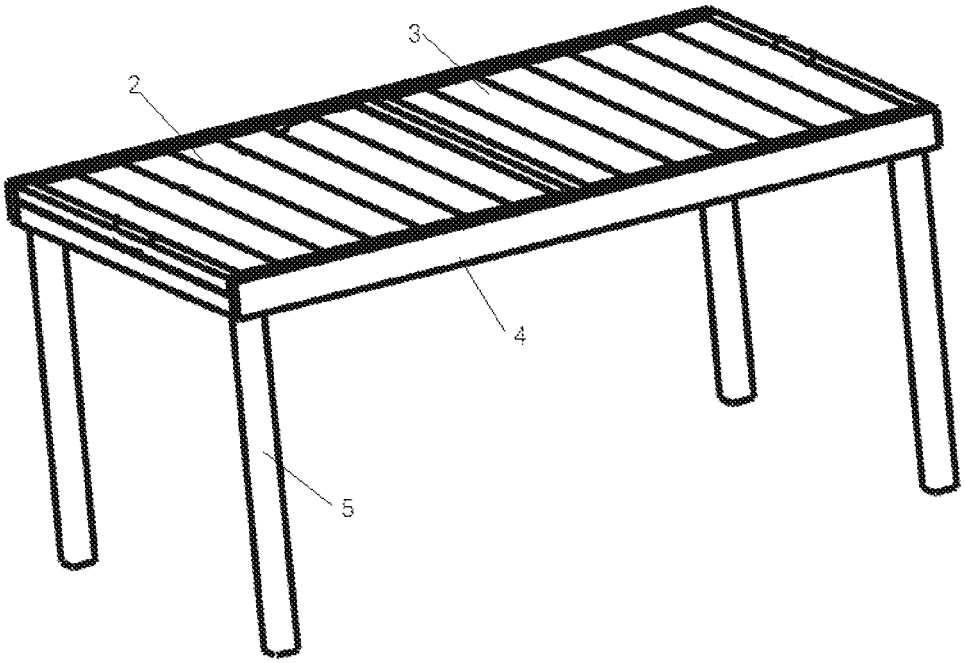
FIG. 2 is a schematic structural diagram of a panel component of a table in a retracted state.

As shown in FIG. 1, the panel component on the table in FIG. 1 is in an unfolded state. As shown in FIG. 2, the panel component on the table in FIG. 2 is in a retracted state.

The slideway 12 is horizontally provided along the length direction of the frame 4, and sliders or pulleys matched with the slideway 12 can be provided on both sides of the second panel 2 to facilitate the sliding connection between the second panel 2 and the frame 4. The structure of the slideway 12 and the slider is the existing conventional structure, which will not be described in detail here.

The terms such as "forward" and "reverse" refer to relative terms, one of which is clockwise and the other is counterclockwise.

In the telescopic panel component of this embodiment, when the second panel 2 slides to the side of the first panel 1 along the slideway 12 on the frame 4 under the action of an external force, the first panel 1 is rotatable on the frame 4. When the first panel 1 turns over forward, the first panel 1 is rotatable below the second panel 2, and the first panel 1 and the second panel 2 form a structure with an upper layer and a lower layer. The panel component is in the retracted state. The panel component only places objects through the second panel 2, which is suitable for use in a small space. When the first panel 1 turns over reversely, the first panel 1 is rotatable to the position where the first panel is spliced with the second panel 2, and the two panels are in the same plane, so that the panel component is in the unfolded state.

At this time, the panel component can place objects through the first panel 1 and the second panel 2, and the surface supporting area of the panel component is large, which is suitable for use in a larger space.

Figure 7:
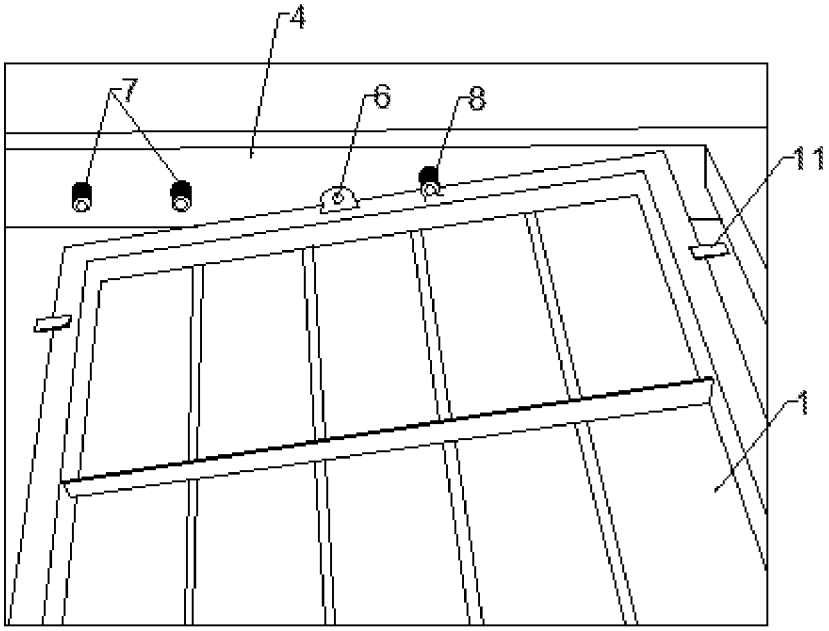
FIG. 7 is a schematic structural diagram of a limiting component and a first panel when a first panel turns over.
Figure 8:
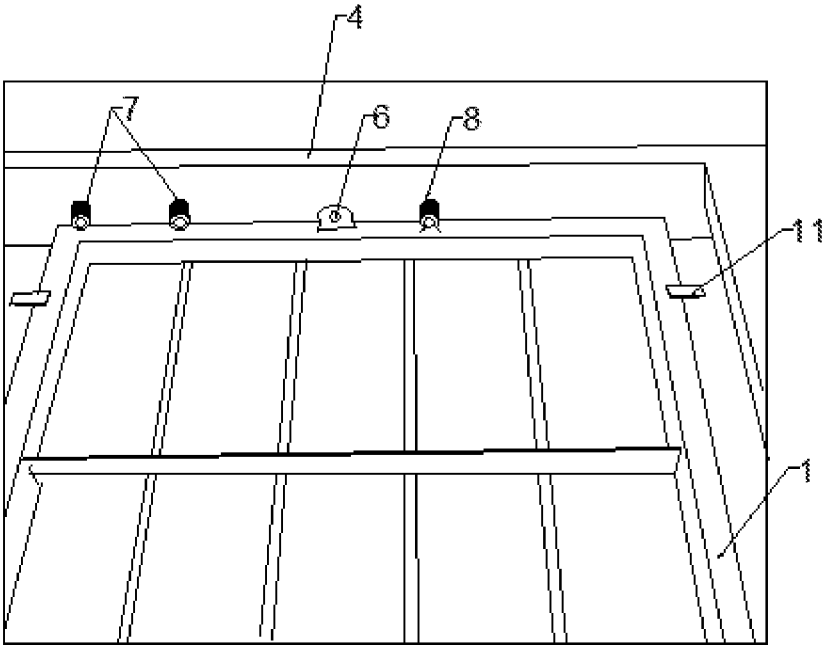
FIG. 8 is a schematic structural diagram when a first panel abuts against a lower part of a limiting component.
Figure 9:
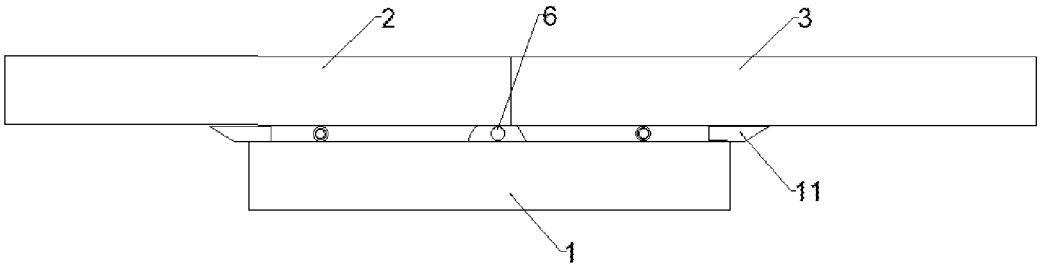
FIG. 9 is a side view of a first panel, a second panel and a third panel in the unfolded state.

In order to further increase the adjustable area of the panel component, as an alternative embodiment, as shown in FIGS. 1-10, the panel component further comprises a third panel 3, and the third panel 3 is slidably connected with the slideway 12; when the second panel 2 and the third panel 3 slide along the slideway 12 to the side of the first panel 1 under the action of an external force, the first panel 1 is rotatable on the frame 4; as shown in FIGS. 2 and 9, when in the retracted state, the second panel 2 and the third panel 3 are spliced, and the first panel 1 component is located below the second panel 2 and the third panel 3. At this time, the sides of the second panel 2 and the third panel 3 are flush with the side of the frame.

Figure 10:
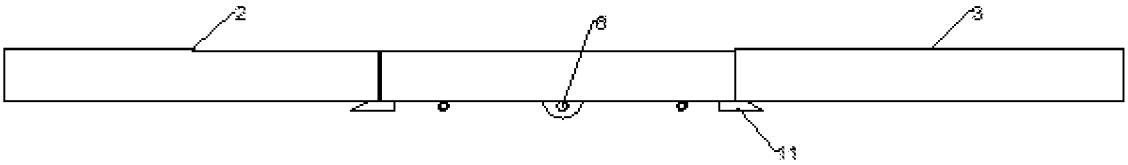
FIG. 10 is a side view of a first panel, a second panel and a third panel in the retracted state.

The first panel 1 turns over reversely, as shown in FIG. 1 and FIG. 10. The first panel 1 is rotatable to the position where the opposite sides are spliced with the second panel 2 and the third panel 3, respectively, and the sides of the second panel 2 and the third panel 3 extend out of the frame 4, so that the panel component is in the unfolded state.

The telescopic panel component of this embodiment slides on the frame 4 through the second panel 2 and the third panel 3, and the first panel 1 is rotatable on the frame 4. When the first panel 1 is rotated to the lower layer of the second panel 2 and the third panel 3, the second panel 2 and the third panel 3 are spliced and used as the usable part of the panel component, which is suitable for use in a small space. For example, when the panel component is applied to a table, it is suitable for use in small-sized households, as shown in FIG. 2 and FIG. 10. When the first panel 1 is rotated to be located in the same plane as the second panel 2 and the third panel 3, the first panel 1 is clamped between the second panel 2 and the third panel 3. The first panel, the second panel and the third panel are spliced and used as usable parts of the panel component, which is suitable for use in a larger space. For example, when the panel component is applied to a table, it is suitable for use in large-sized households, as shown in FIGS. 1 and 9.

This embodiment provides a specific embodiment that the first panel 1 is rotatable. As shown in FIGS. 7-10, the panel component further comprises rotating shaft parts 6, wherein the rotating shaft parts 6 are located at opposite sides of the first panel 1 and rotatably connect the first panel 1 with the frame 4; when in the retracted state, the rotating shaft part 6 is located at the upper part of the first panel 1, and when in the unfolded state, the rotating shaft part 6 is located at the lower part of the first panel 1.

Figure 3:
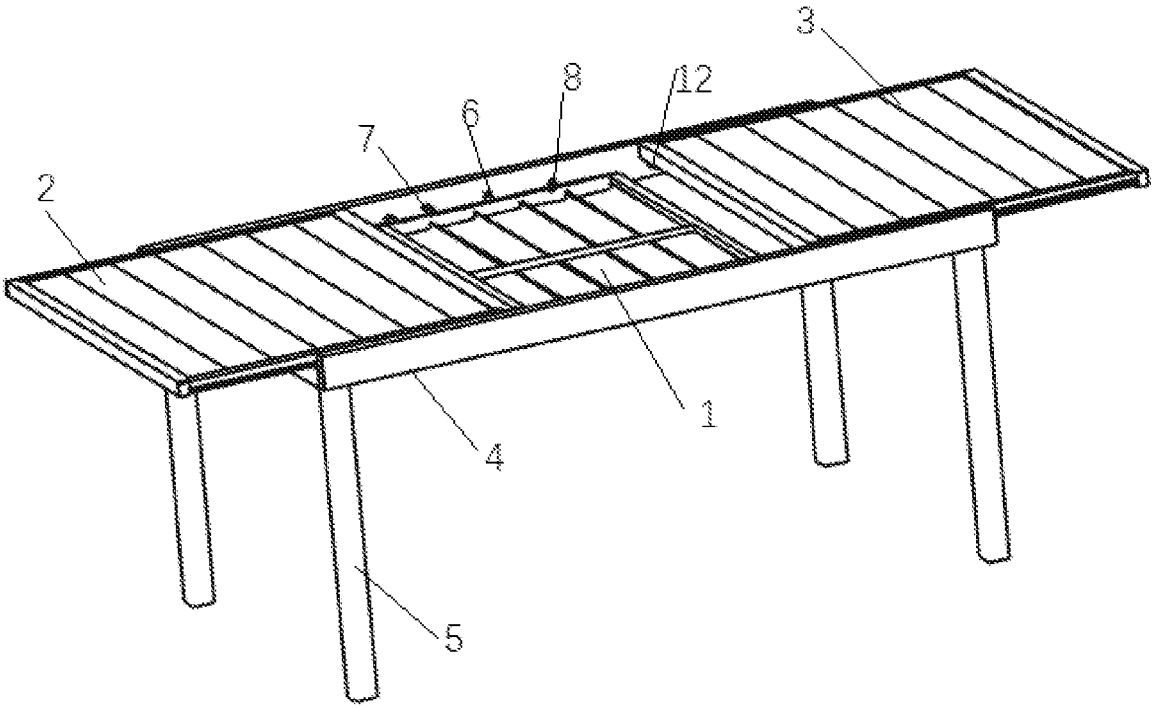
FIG. 3 is a schematic structural diagram when a second panel and a third panel slide to the side of the first panel.
Figure 4:
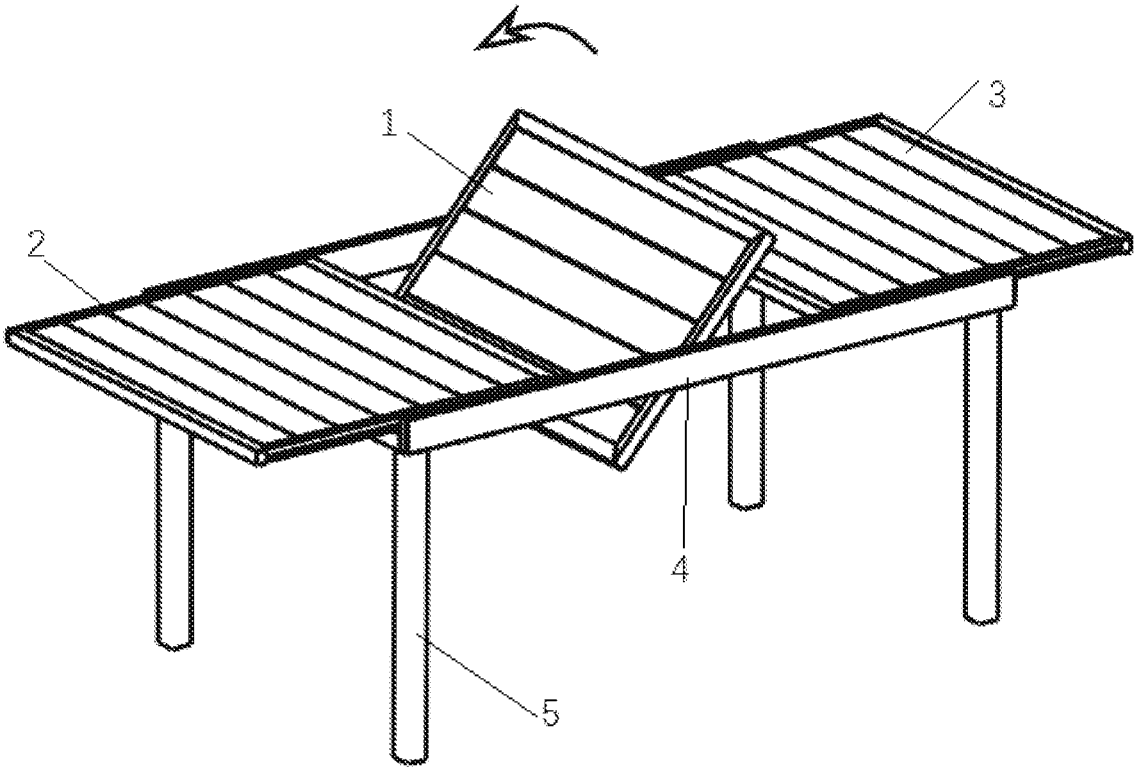
FIG. 4 is a schematic diagram of the state when a first panel turns over.

The rotating shaft part 6 comprises a rotating shaft that rotatably connects the inner side of the frame 4 with the side of the first panel 1. When the second panel 2 and the third panel 3 are located on the upper layer of the first panel 1, as shown in FIG. 9, the first panel 1 is restricted by the second panel 2 and the third panel 3, and cannot rotate, thus ensuring the stability of the panel component. As shown in FIG. 3 and FIG. 4, when the second panel 2 and the third panel 3 slide along the slideway 12 to the side of the first panel 1 under the action of an external force, the first panel 1 can be rotated at this time, and the first panel 1 rotates around the rotating shaft part 6, so that the panel component is in the unfolded state or the retracted state.

As shown in FIG. 2, when the panel component is in the retracted state, in order to fix the second panel 2 and the third panel 3 with the frame 4 and prevent the second panel 2 and the third panel 3 from sliding under the action of an external force, as an alternative embodiment, the panel component of this embodiment further comprises at least two locking mechanisms 9, and the locking mechanisms 9 enable the second panel 2 and the frame 4 to be in the locking state and the third panel 3 and the frame 4 to be in the locking state, and enable the second panel 2 to be unlocked from the frame 4 and the third panel 3 to be unlocked from the frame 4.

The locking mechanism 9 has the function of locking the second panel 2 and the frame 4, and the third panel 3 and the frame 4 when the panel component is in a retracted state, so as to prevent the second panel 2 and the third panel 3 from sliding under the action of an external force and ensure the stability of the panel component. When the panel component needs to expand the use area, the locking mechanism 9 enables the second panel 2 to be unlocked from the frame 4 and the third panel 3 to be unlocked from the frame 4. At this time, it is convenient for the user to push or pull the second panel 2 and the third panel 3, and pull the second panel 2 and the third panel 3 to the side of the first panel 1, which is convenient to unfold the panel component.

Figure 5:
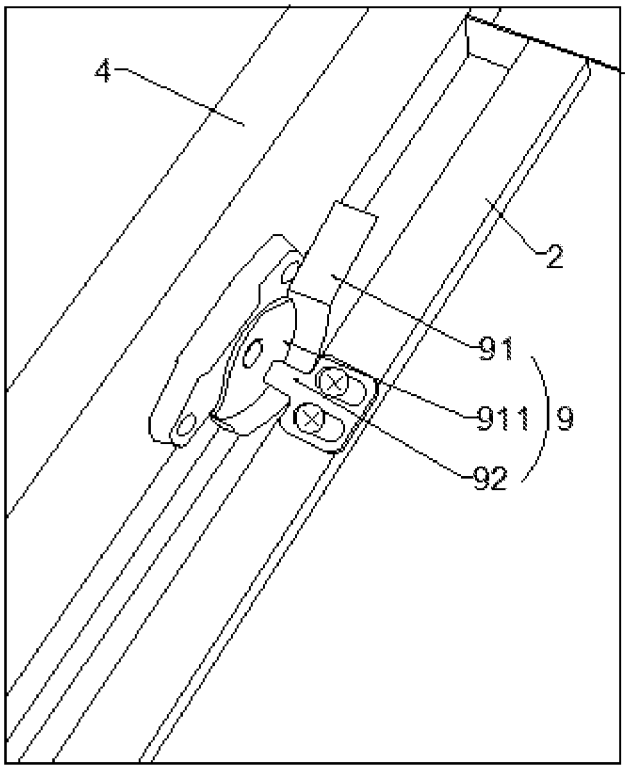
FIG. 5 is a schematic structural diagram of a locking mechanism that locks a second panel and a frame.
Figure 6:
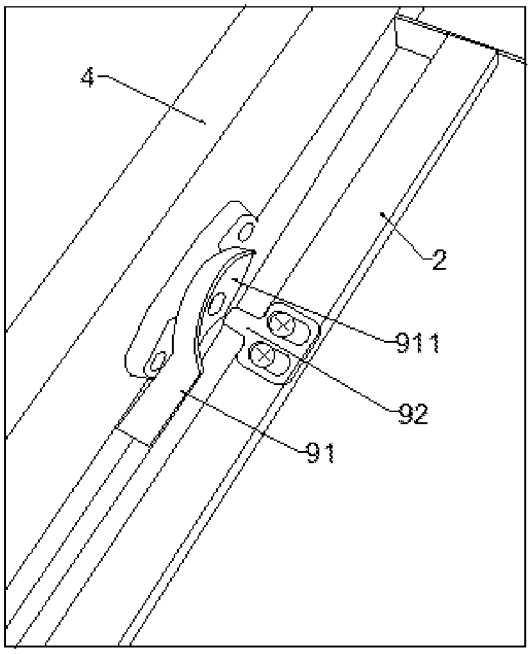
FIG. 6 is a schematic structural diagram of a locking mechanism that unlocks a second panel from a frame.

Specifically, in this embodiment, a specific implementation of the locking mechanism 9 is provided. As shown in FIGS. 5 and 6, the perspective of FIGS. 5 and 6 is from the bottom. The locking mechanism 9 comprises a tongue 92 and a lock cover 91, wherein: the lock cover 91 is rotatably connected to the side of the frame 4. Specifically, the lock cover 91 is located at the inner side of the frame 4, and is fixed to one side of the second panel 2 or the third panel 3 corresponding to the tongue 92; a limiting plate 911 is provided on the lock cover 91. When the lock cover 91 rotates to the position where the tongue 92 abuts against the limiting plate 911, as shown in FIG. 5, the lock cover is capable of limiting the sliding of the second panel 2 and the third panel 3; when the lock cover 91 rotates until the limiting plate 911 is separated from the corresponding tongue 92, as shown in FIG. 6, the lock cover enables the second panel 2 to be unlocked from the frame 4 or the third panel 3 to be unlocked from the frame 4.

Specifically, the lock cover 91 is rotatably connected to the inner side of the frame 4 through a shaft. When it is necessary to lock the second panel 2 and the frame 4, the third panel 3 and the frame 4, as shown in FIG. 5, the lock cover 91 is rotated to the position where the tongue 92 abuts against the limiting plate 911. At this time, the second panel 2 and the third panel 3 are resisted by the corresponding limiting plate 911. As shown in FIG. 5, the user cannot pull the second panel 2 and the third panel 3. The second panel 2 and the third panel 3 can be stably fixed on the frame 4. As shown in FIG. 6, when the lock cover 91 is rotated to the position where the tongue 92 is separated from the limiting plate 911, the second panel 2 and the third panel 3 are no longer resisted by the corresponding limiting plates 911. As shown in FIG. 6, at this time, the user can pull the second panel 2 and the third panel 3 to the side of the first panel 1, as shown in FIG. 3. The locking mechanism 9 can ensure the stability of the panel component without affecting the unfolding and retraction of the panel component.

When the panel component is in the retracted state and the unfolded state, in order to prevent the first panel 1 from rotating at will, as an alternative embodiment, as shown in FIGS. 7 and 8, the panel component further comprises a limiting component, the limiting component is connected to the inner side of the frame 4; when in the retracted state, the upper edge of the first panel 1 abuts against the lower part of the limiting component, and when in the unfolded state, the lower edge of the first panel 1 abuts against the upper part of the limiting component.

As shown in FIG. 8, when the upper edge of the first panel 1 abuts against the lower part of the limiting component, the first panel 1 is limited by the limiting component, the second panel 2 and the third panel 3, and the first panel 1 will not turn upwards at will without an external force. When the lower edge of the first panel 1 abuts against the upper part of the limiting component, the first panel 1 will not turn upwards at will without an external force, thus ensuring the stability of the structure.

As an alternative embodiment, as shown in FIGS. 7 and 8, the limiting component comprises a first roller 7, the first roller 7 is rotatably connected to the inner side of the frame 4, and when the second panel 2 and the third panel 3 are pushed or pulled, the second panel 2 and the third panel 3 are capable of being in contact with the upper surface of the first roller 7 and pushing the first roller 7 to rotate around its own axis.

The first roller 7 has the following functions. First, the first roller can abut against the upper part or the lower part of the first panel 1, and to some extent, can limit the first panel 1 from rotating at will. Second, when the second panel 2 and the third panel 3 are pushed or pulled, the second panel 2 and the third panel 3 are capable of being in contact with the upper surface of the first roller 7 and roll relatively, which is convenient for the user to push the second panel 2 and the third panel 3 with less effort.

As shown in FIG. 8, specifically, all the first rollers 7 on the same side of the first panel 1 are located on the same side of the rotating shaft part 6. As shown in FIG. 7, in this embodiment, all the first rollers 7 on one side of the first panel 1 are located on the left side of the rotating shaft part 6. When it is necessary to turn over the first panel 1 upwardly to make the panel component in the unfolded state, as shown in FIG. 7, the first panel 1 is rotated counterclockwise, and the first panel 1 rotates around the rotating shaft part 6. At this time, the first roller 7 will not prevent the first panel 1 from rotating.

As an alternative embodiment, as shown in FIGS. 7 and 8, the first panel 1 is provided with a second roller 8, the second roller 8 is located at the upper part of the first panel 1 when in the retracted state, and when the second panel 2 and the third panel 3 are pushed or pulled, the second panel 2 and the third panel 3 are capable of being in contact with the upper surface of the second roller 8 and pushing the second roller 8 to rotate around its own axis.

Specifically, the first roller 7 and the second roller 8 on the same side of the first panel 1 are located on both sides of the rotating shaft part 6, respectively. As shown FIG. 7, in this embodiment, all the first rollers 7 on one side of the first panel 1 are located on the left side of the rotating shaft part 6, and the second roller 8 is located on the right side of the rotating shaft part 6. When the panel component is adjusted to the retracted state, the second panel 2 or the third panel 3 can be in contact with the upper surface of the second roller 8 and roll relatively, which is convenient for the user to push the second panel 2 and the third panel 3 with less effort.

As an alternative embodiment, as shown in FIG. 10, both sides of the first panel 1 are provided with supporting plates 11 for supporting the second panel 2 and the third panel 3. As shown in FIG. 10, the supporting plates 11 are located at the lower part of the first panel 1 and support the lower parts of the second panel 2 and the third panel 3 when in the unfolded state.

In this embodiment, the first panel 1, the second panel 2, and the third panel 3 have the same thickness, and the second panel 2 and the third panel 3 are supported by the supporting plate 11 on the first panel 1, so that the first panel, the second panel, and the third panel are located in the same plane to be spliced, and the stability of the structure can be ensured. Similarly, the lower parts of the second panel 2 and the third panel 3 can also be provided with supporting plates 11. The supporting plates 11 on the second panel 2 and the supporting plates 11 on the first panel 1 are staggered along the width direction of the frame 4 to prevent the splicing of the first panel 1 and the second panel 2 from being affected. The supporting plate 11 on the third panel 3 and the supporting plate 11 on the first panel 1 are staggered along the width direction of the frame 4, so as to prevent the splicing of the first panel 1 and the third panel 3 from being affected.

Embodiment 2

This embodiment provides a table, as shown in FIGS. 1-4, comprising legs 5 and the panel component, wherein all the legs 5 are fixedly connected to the lower part of the panel component and support the panel component.

The legs 5 and the frame 4 can be welded or connected detachably by bolts.

Since the table of this embodiment has the telescopic panel component, the supporting area of the surface of the table can be adjusted telescopically, which can be applied to holes in a smaller space and a larger space, thus improving the universality of the table and making it more convenient to use.

In the description of this specification, the specific features, structures or features may be combined in any one or more embodiments or examples in a suitable manner.

In the description of this specification, the description referring to the terms "one embodiment", "some embodiments", "examples", "specific examples" or "some examples" means that the specific features, structures, materials or characteristics described in connection with this embodiment or example are included in at least one embodiment or example of the present disclosure. In this specification, the schematic expressions of the above terms do not necessarily refer to the same embodiment or example. Furthermore, the specific features, structures, materials or characteristics described may be combined in any one or more embodiments or examples in a suitable manner. In addition, those skilled in the art can integrate and combine different embodiments or examples and features of different embodiments or examples described in this specification without contradicting each other.

The above are only the specific embodiments of the present disclosure, but the scope of protection of the present disclosure is not limited thereto. Any changes or substitutions conceivable to those skilled in the art within the technical scope disclosed by the present disclosure should be included within the scope of protection of the present disclosure. Therefore, the scope of protection of the present disclosure should be based on the scope of protection of the claims.

What is claimed is:

1. A telescopic panel component, comprising a frame, a first panel and a second panel, wherein:

a slideway is provided on the frame, and the second panel is slidably connected with the slideway; the panel component has a retracted state and an unfolded state, and when the second panel slides along the slideway to the side of the first panel under the action of an external force, the first panel is rotatable on the frame;

the first panel turns over forward, and the first panel is rotatable below the second panel, so that the panel component is in the retracted state; the first panel turns over reversely, and the first panel is rotatable to the position where the first panel is spliced with the second panel, so that the panel component is in the unfolded state;

wherein the panel component further comprises a third panel, and the third panel is slidably connected with the slideway;

when the second panel and the third panel slide along the slideway to the side of the first panel under the action of an external force, the first panel is rotatable on the frame;

when in the retracted state, the second panel and the third panel are spliced, and the first panel component is located below the second panel and the third panel;

the first panel turns over reversely, the first panel is rotatable to the position where the opposite sides are spliced with the second panel and the third panel, respectively, and the sides of the second panel and the third panel extend out of the frame, so that the panel component is in the unfolded state;

wherein the panel component further comprises at least two locking mechanisms, and the locking mechanisms enable the second panel and the frame to be in the locking state and the third panel and the frame to be in the locking state, and enable the second panel to be unlocked from the frame and the third panel to be unlocked from the frame.

2. The telescopic panel component according to claim 1, wherein the panel component further comprises rotating shaft parts, wherein the rotating shaft parts are located at opposite sides of the first panel and rotatably connect the first panel with the frame;

when in the retracted state, the rotating shaft part is located at the upper part of the first panel, and when in the unfolded state, the rotating shaft part is located at the lower part of the first panel.

3. The telescopic panel component according to claim 1, wherein the locking mechanism comprises a tongue and a lock cover, wherein:

the lock cover is rotatably connected to the side of the frame, and is fixed to one side of the second panel or the third panel corresponding to the tongue; a limiting plate is provided on the lock cover, and when the lock cover rotates to the position where the tongue abuts against the limiting plate, the lock cover is capable of limiting the sliding of the second panel and the third panel;

when the lock cover rotates until the limiting plate is separated from the corresponding tongue, the lock cover enables the second panel to be unlocked from the frame or the third panel to be unlocked from the frame.

4. The telescopic panel component according to claim 1, wherein the panel component further comprises a limiting component, the limiting component is connected to the inner side of the frame; when in the retracted state, the upper edge of the first panel abuts against the lower part of the limiting component, and when in the unfolded state, the lower edge of the first panel abuts against the upper part of the limiting component.

5. The telescopic panel component according to claim 4, wherein the limiting component comprises a first roller, the first roller is rotatably connected to the inner side of the frame, and when the second panel and the third panel are pushed or pulled, the second panel and the third panel are capable of being in contact with the upper surface of the first roller and pushing the first roller to rotate around its own axis.

6. The telescopic panel component according to claim 5, wherein the first panel is provided with a second roller, the second roller is located at the upper part of the first panel when in the retracted state, and when the second panel and the third panel are pushed or pulled, the second panel and the third panel are capable of being in contact with the upper surface of the second roller and pushing the second roller to rotate around its own axis.

7. The telescopic panel component according to claim 1, wherein both sides of the first panel are provided with supporting plates for supporting the second panel and the third panel.

* * * * *